US009801523B2

(12) United States Patent
Thiyagarajan

(10) Patent No.: US 9,801,523 B2
(45) Date of Patent: Oct. 31, 2017

(54) SPRAY DEVICE ASSEMBLY FOR DISHWASHER APPLIANCE

(71) Applicant: General Electric Company, Schenectady, NY (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 481 days.

(21) Appl. No.: 14/469,629

(22) Filed: Aug. 27, 2014

(65) Prior Publication Data

US 2016/0058264 A1 Mar. 3, 2016

(51) Int. Cl.
*A47L 15/42* (2006.01)
*A47L 15/22* (2006.01)

(52) U.S. Cl.
CPC ..... *A47L 15/4282* (2013.01); *A47L 15/22* (2013.01)

(58) Field of Classification Search
CPC ..... A47L 15/22; A47L 15/4282
See application file for complete search history.

(56) References Cited

U.S. PATENT DOCUMENTS 2,154,559 A 4/1939 Bilde
2,351,342 A * 6/1944 Karlstrom ..... A01J 9/04 134/172
3,006,557 A * 10/1961 Jacobs ..... A47L 15/18 134/181
3,019,802 A * 2/1962 Mercer ..... A47L 15/4409 134/174
3,051,183 A * 8/1962 Jacobs ..... A47L 15/23 134/107
3,088,474 A * 5/1963 Leslie ..... A47L 15/0049 134/113
3,146,953 A * 9/1964 Komanns ..... A47L 15/22 239/102.1
3,217,884 A * 11/1965 Long ..... B01D 29/115 134/111
3,880,357 A * 4/1975 Baisch ..... B05B 3/14 239/225.1

(Continued)

FOREIGN PATENT DOCUMENTS

FR 2607728 A1 * 6/1988 ..... B05B 1/20
WO WO 2011/154471 A1 12/2011

OTHER PUBLICATIONS

Machine translation of FR 2607728 A1 to Perrotin, Jun. 1988.*

*Primary Examiner* — Michael Kornakov
*Assistant Examiner* — Benjamin L Osterhout
(74) *Attorney, Agent, or Firm* — Dority & Manning, P.A.

(57) ABSTRACT

A spray device assembly for a dishwasher appliance is provided including an outer tube and an inner tube. The outer tube extends along an axial direction and defines an outer tube orifice extending along a length of the outer tube. The inner tube also extends along the axial direction and is rotatably positioned at least partially within an opening of the outer tube. Moreover, the inner tube defines an inner tube orifice extending along a length of the inner tube. The outer tube orifice and inner tube orifice together define a nozzle where the outer tube orifice and the inner tube orifice overlap, the nozzle configured to move along the outer tube orifice as the inner tube and the outer tube are rotated relative to one another.

16 Claims, 9 Drawing Sheets

(56) References Cited

U.S. PATENT DOCUMENTS

| | | | | | |
|---|---|---|---|---|---|
| 4,135,532 | A | * | 1/1979 | Rutherford | A47L 15/0089 134/100.1 |
| 5,267,582 | A | * | 12/1993 | Purtilo | A47L 15/22 134/180 |
| 5,582,742 | A | * | 12/1996 | Wilkie | B04B 11/06 210/360.1 |
| 2006/0278258 | A1 | | 12/2006 | Kara et al. | |

* cited by examiner

SPRAY DEVICE ASSEMBLY FOR DISHWASHER APPLIANCE

FIELD OF THE INVENTION

The present subject matter relates generally to dishwasher appliances, and more particularly to a spray device assembly for a dishwasher appliance.

BACKGROUND OF THE INVENTION

Dishwashing appliances generally include a tub defining a wash chamber or compartment wherein one or more rack assemblies are positioned. Various articles may be loaded in the one or more rack assemblies for cleaning. Each rack may include features such as, e.g., tines that hold and orient the articles to receive sprays of wash and rinse fluids during the cleaning process. The articles to be cleaned may include a variety of dishes, cooking utensils, silverware, and other items.

Dishwashing appliances are also typically provided with one or more spray assemblies that can apply or direct wash fluid towards articles disposed within the rack assemblies in order to clean such articles. The spray assemblies can include a lower spray assembly mounted to the tub at a bottom of the wash chamber, a mid-level spray arm assembly mounted to an upper rack assembly, and a top spray assembly mounted to the tub at a top of the wash chamber.

Conventionally, such spray assemblies may include one or more spray arms attached to a hub, the one or more spray arms configured to rotate about a vertical direction relative to the wash chamber. Additionally, the spray arms typically include a discrete number of nozzles positioned along a length of the spray arms through which a fluid flows under pressure to provide a spray onto the articles during a wash or rinse cycle. The orientation of the nozzles combined with the action and reaction forces of the exiting fluid causes the spray arms of the spray assemblies to rotate about the vertical direction relative to the wash chamber so long as a sufficient amount of fluid under pressure is supplied to the spray arms. The rotation of the spray arms and the number of nozzles positioned thereon may help improve coverage of the fluid over the articles in the rack assemblies.

Depending upon e.g., the orientation and shape of articles placed in the rack assemblies, however, the fluid provided by such conventional rotating spray arms may not be able to impact all surfaces of the articles. More particularly, conventional rotating spray arms may not be able to effectively reach articles positioned between adjacent nozzles. In certain dishwasher appliances, the number of nozzles on the spray arms has been increased to account for this limitation. However, increasing the number of nozzles may require more water to prime the system, higher flow rate pumps, and use of more water and energy.

Accordingly, a spray arm assembly for a dishwashing appliance that can provide improved spraying of fluid onto articles in the wash chamber during the cleaning process would be useful. More particularly, a spray arm assembly for a dishwashing appliance that can improve spray coverage of the nozzle(s) without increasing the number of nozzles required would be particularly beneficial.

BRIEF DESCRIPTION OF THE INVENTION

Aspects and advantages of the invention are set forth below in the following description, or may be obvious from the description, or may be learned through practice of the invention.

In one exemplary embodiment of the present disclosure, a spray device assembly for a dishwasher appliance is provided, the spray device assembly defining an axial direction and including an outer tube and an inner tube. The outer tube extends along the axial direction and defines an opening and an outer tube orifice extending along a length of the outer tube. The inner tube is rotatably positioned at least partially within the opening of the outer tube. The inner tube defines an inner tube orifice extending along a length of the inner tube. Additionally, the outer tube orifice and inner tube orifice together define a nozzle where the outer tube orifice and the inner tube orifice overlap. The nozzle is configured to move along the outer tube orifice as the inner tube and the outer tube are rotated relative to one another.

In another exemplary embodiment of the present disclosure, a dishwasher appliance is provided, the dishwasher appliance including a cabinet defining a wash compartment; a circulation assembly fluidly connected to the wash compartment for circulating a wash liquid; and a spray device assembly. The spray device assembly defines an axial direction and is configured to receive wash liquid from the circulation assembly. Additionally, the spray device assembly includes an outer tube extending along the axial direction, the outer tube defining an opening and an outer tube orifice extending along a length of the outer tube. Moreover, the spray device assembly includes an inner tube rotatably positioned at least partially within the opening of the outer tube, the inner tube defining an inner tube orifice extending along a length of the inner tube. The outer tube orifice and inner tube orifice together define a nozzle where the outer tube orifice and the inner tube orifice overlap. The nozzle is configured to move along the outer tube orifice as the inner tube and the outer tube are rotated relative to one another.

In yet another exemplary embodiment of the present disclosure, a spray device assembly for a dishwasher appliance is provided, the spray device assembly defining an axial direction and including an outer tube extending along the axial direction. The outer tube defines an opening and a plurality of outer holes spaced apart from one another along the axial direction, the plurality of outer holes distributed along a fixed trajectory along the outer tube. The spray device assembly also includes an inner tube rotatably positioned at least partially within the opening of the outer tube, the inner tube defining a plurality of inner holes spaced apart from one another along the axial direction. The plurality of inner holes are distributed along a fixed trajectory along the inner tube. Additionally, the plurality of inner holes are configured to sequentially overlap with the plurality of outer holes as the inner tube and the outer tube are rotated relative to one another, the overlapping inner and outer holes defining a nozzle that moves along the axial direction as the inner tube and the outer tube are rotated relative to one another.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
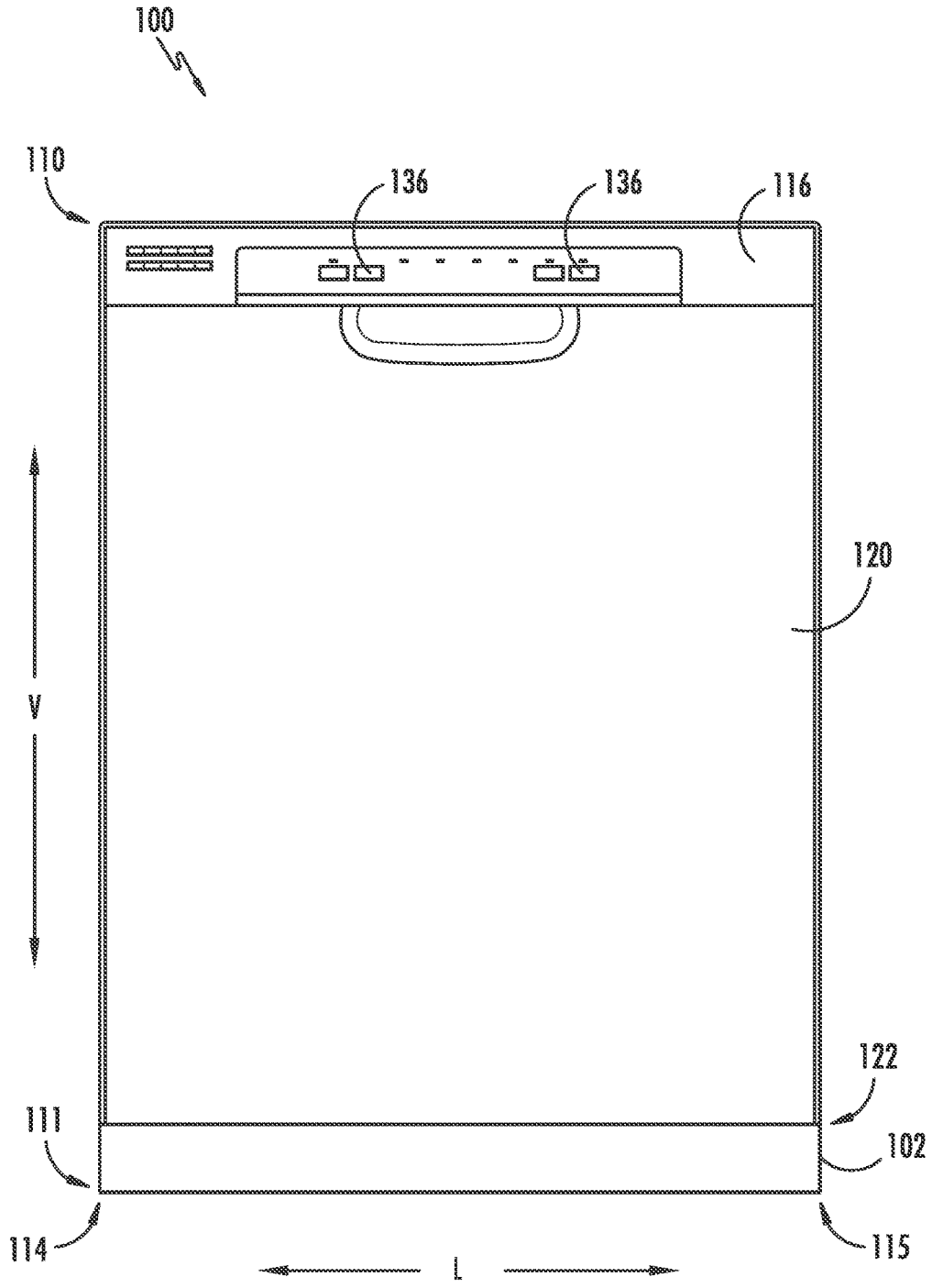
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
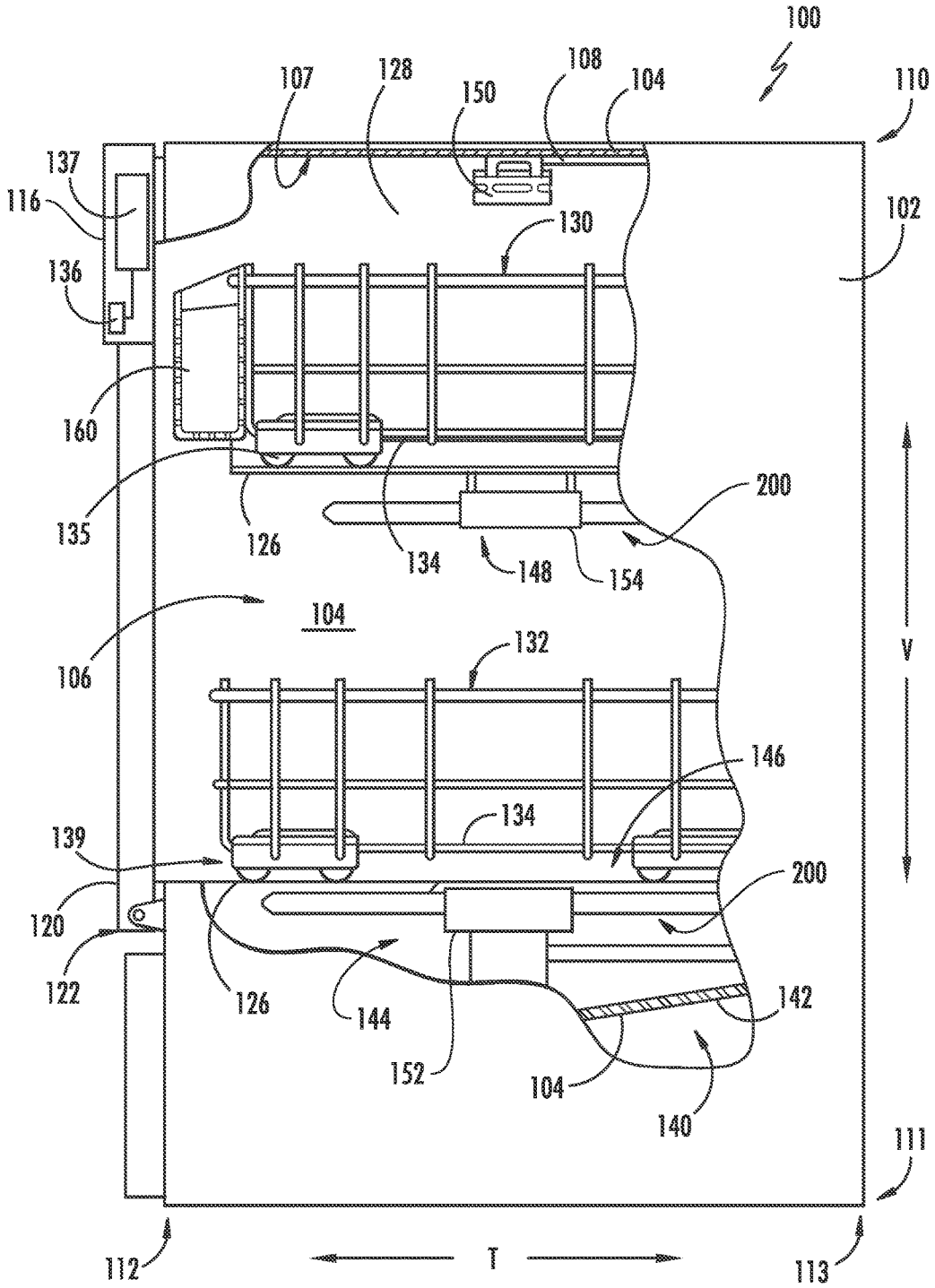
FIG. 2 provides a side, section view of the exemplary dishwasher appliance of FIG. 1.

FIGS. 1 and 2 depict a dishwasher appliance 100 according to an exemplary embodiment of the present subject matter. More particularly, FIG. 1 provides a front view of the dishwasher appliance 100 and FIG. 2 provides a cutaway side view of the dishwasher appliance 100. The dishwasher appliance 100 defines a vertical direction V, a lateral direction L and a transverse direction T. The vertical direction V, the lateral direction L, and the transverse direction T are mutually perpendicular and form an orthogonal direction system. As may be seen in FIG. 1, the dishwasher appliance 100 extends between a top portion 110 and a bottom portion 111 along the vertical direction V and also extends between a first side portion 114 and a second side portion 115 along the lateral direction L. As may be seen in FIG. 2, the dishwasher appliance 100 also extends between a front portion 112 and a back portion 113 along the transverse direction T.

Referring specifically to FIG. 2, the dishwasher appliance 100 includes a cabinet 102 having a tub 104 therein that defines a wash compartment 106. In particular, the tub 104 includes a top wall 107 that assists in defining the wash compartment 106. The tub 104 also includes a door 120 hinged at its bottom 122 for movement between a normally closed configuration (shown in FIGS. 1 and 2) in which the wash compartment 106 is sealed shut, e.g., for washing operation, and an open configuration, e.g., for loading and unloading of articles from dishwasher appliance 100.

Guide rails 126 are mounted on tub side walls 128 and accommodate upper and lower roller-equipped rack assemblies 130, 132, respectively. Each of the upper and lower rack assemblies 130, 132 is fabricated from lattice structures that include a plurality of elongated members 134. Each rack of the upper and lower rack assemblies 130, 132 is adapted for movement between an extended loading position (not shown) in which the rack is positioned substantially outside the wash compartment 106, and a retracted position (shown in FIG. 2) in which the rack is located inside the wash compartment 106.

A silverware basket 160 is removably mounted to the upper rack assembly 130. However, the silverware basket 160 may alternatively be selectively attached to other portions of the dishwasher appliance 100, e.g., the lower rack 132 or the door 120. The silverware rack 160 is configured for receipt of silverware, utensils, and the like, that are too small to be accommodated by the upper and lower rack assemblies 130, 132.

Referring still specifically to FIG. 2, the exemplary dishwasher appliance 100 additionally includes a lower spray assembly 144 that is mounted within a lower region 146 of the wash compartment 106 and above a tub sump portion 142 so as to be in relatively close proximity to the lower rack 132. Moreover, the dishwasher appliance 100 includes a mid-level spray assembly 148, which is located in an upper region of the wash compartment 106 and may be located in close proximity to the upper rack 130. Further, an upper spray assembly 150 is located above the upper rack 130 and mounted to the top wall 107 of the tub 104. The spray assemblies depicted in FIG. 2 are configured to rotate about the vertical direction V during operation of the dishwasher appliance 100.

The lower and mid-level spray assemblies 144, 148 and the upper spray assembly 150 are fed by a fluid circulation assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art. The fluid circulation assembly also includes circulation piping 108 that directs water and/or wash fluid to upper spray assembly 150.

Additionally, the lower spray assembly 144 includes a hub 152 and a pair of spray device assemblies 200 configured to rotate about the vertical direction V during operation of the lower spray assembly 144. Similarly, the upper spray assembly 148 includes a hub 154 and a pair of spray device assemblies 200 configured to rotate about the vertical direction V during operation of the upper spray assembly 148.

For the exemplary embodiment depicted in FIG. 2, the spray device assemblies 200 are configured as spray arm assemblies. It should be appreciated, however, that in other exemplary embodiments, the dishwasher appliance 100 may additionally or alternatively include any other suitable number, configuration, or position of spray device assemblies 200. For example, in other exemplary embodiments, the dishwasher appliance 100 may additionally or alternatively include spray device assemblies 200 configured as stationary spray device assemblies 200, one or more dedicated spray device assemblies 200 for the silverware rack 160, one or more dedicated spray device assemblies 200 for washing bottles, one or more linear movement spray device assemblies 200, etc.

Referring still to FIG. 2, the dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 116 of the door 120, as shown. In such an embodiment, input/output ("I/O") signals may be routed between the control system and various operational components of dishwasher appliance 100 along wiring harnesses that may be routed through the bottom 122 of the door 120. Typically, the controller 137 includes a user interface panel 136 (also shown in FIG. 1) through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated, however, that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances 100 having any other suitable rack configuration, door configuration, and/or spray assembly configuration.

Figure 3:
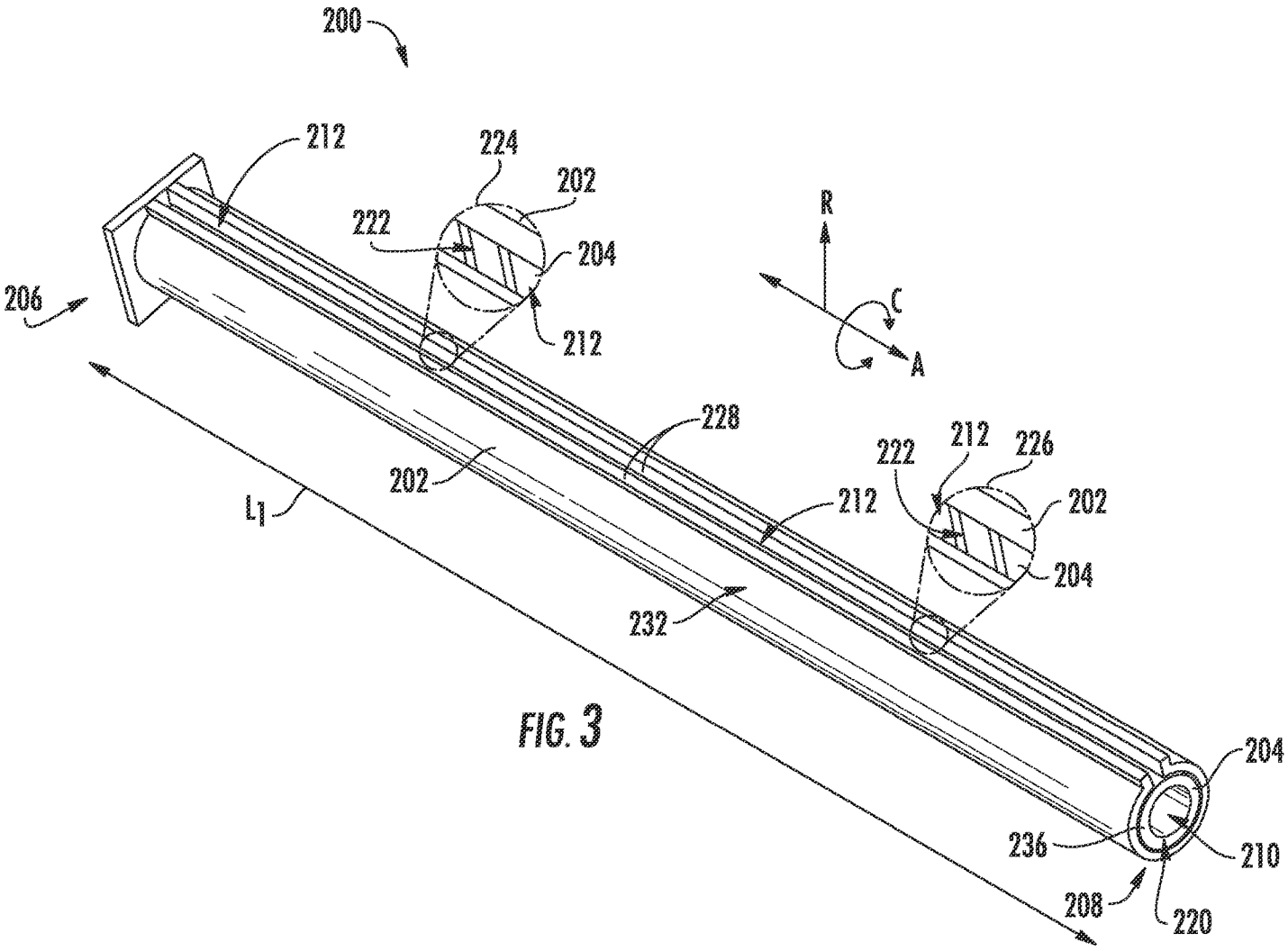
FIG. 3 provides a perspective view of a spray device assembly according to an exemplary embodiment of the present subject matter.
Figure 4:
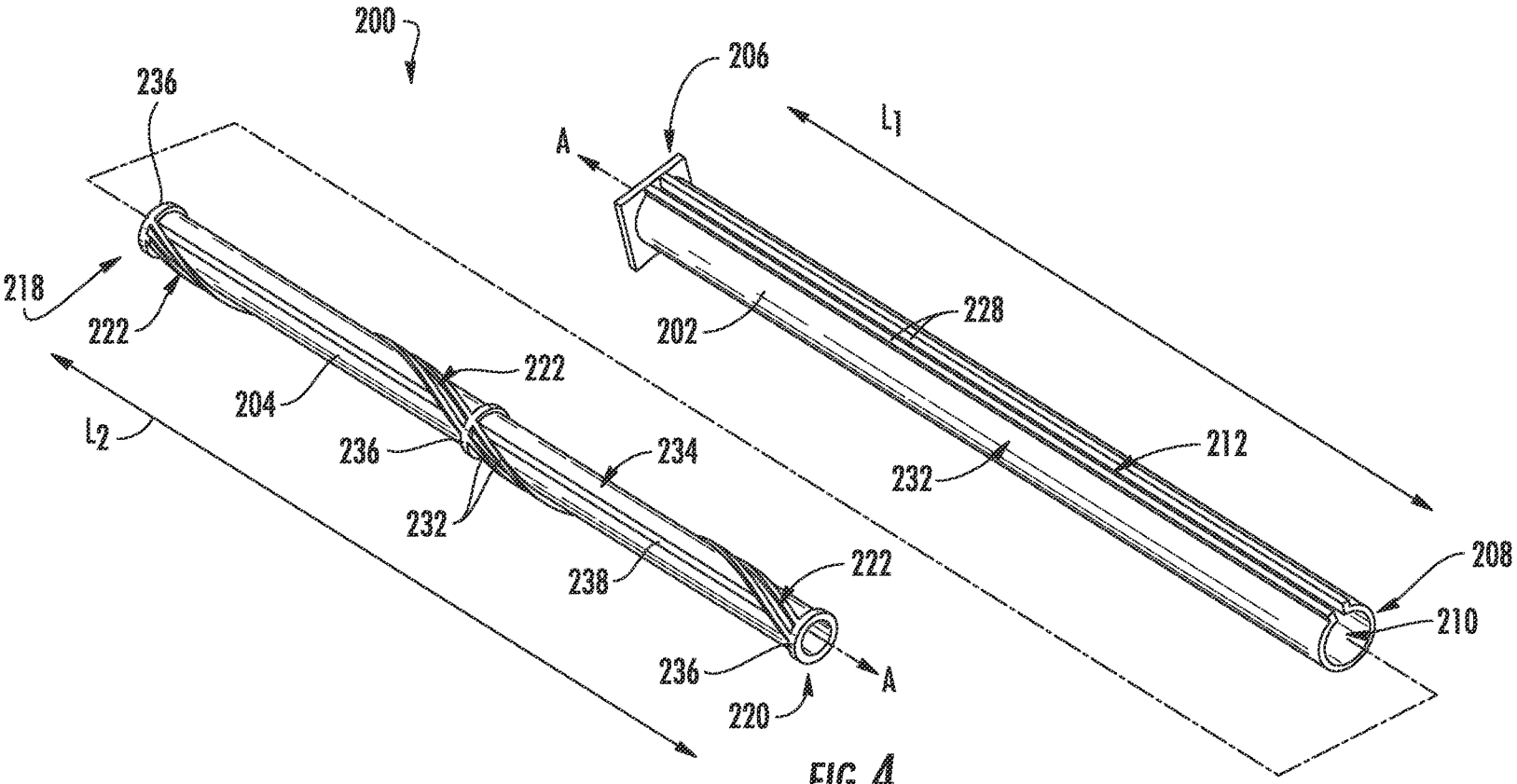
FIG. 4 provides an exploded view of the exemplary spray device assembly of FIG. 3.

Referring now to FIGS. 3 and 4, an exemplary spray device assembly 200 is depicted. More particularly, FIG. 3 provides a perspective view of an exemplary spray device assembly 200 in accordance with an exemplary embodiment of the present disclosure and FIG. 4 provides an exploded view of the exemplary spray device assembly 200 of FIG. 3. The spray device assembly 200 generally defines an axial direction A, a radial direction R, and a circumferential direction C. Moreover, the spray device assembly 200 includes an outer tube 202 and an inner tube 204.

The outer tube 202 extends along the axial direction A between a first end 206 and a second end 208, and defines an opening 210. The opening 210 depicted defines a substantially cylindrical shape and extends along a length of the outer tube 202. Moreover, the outer tube 202 defines an outer tube orifice 212. The outer tube orifice 212 also extends along a length of the outer tube 202. More particularly, for the exemplary embodiment depicted, the opening 210 and the outer tube orifice 212 each extend along an entire length $L_1$ of the outer tube 202 between the first end 206 and the second end 208.

The inner tube 204 is rotatably positioned at least partially within the opening 210 of the outer tube 202 and also extends along the axial direction A between a first end 218 and a second end 220. For the embodiment of FIG. 3, the inner tube 204 is rotatably positioned completely within the opening 210 of the outer tube 202 such that the first end 218 of the inner tube 204 is proximate the first end 206 of the outer tube 202 and the second end 220 of the inner tube 204 is proximate the second end 208 of the outer tube 202 (see FIG. 3).

The inner tube 204 also defines an inner tube orifice 222 extending along a length of the inner tube 204. For the exemplary embodiment depicted, the inner tube orifice 222 extends along an entire length $L_2$ of the inner tube 204 between the first end 218 and the second end 220.

The inner tube orifice 222 extends in a direction non-parallel to the outer tube orifice 212. For example, in FIGS. 3 and 4, the inner tube orifice 222 is depicted extending helically around the inner tube 204, and the outer tube orifice 212 is depicted extending linearly along the outer tube 202. As will be explained in greater detail below with reference to FIGS. 6 and 7, the outer tube orifice 212 and inner tube orifice 222 together define a first nozzle 224 (FIG. 3) where the outer tube orifice 212 and the inner tube orifice 222 overlap at a first location, and also define a second nozzle 226 (FIG. 3) where the outer tube orifice 212 and the inner tube orifice 222 overlap at a second location. The first and second nozzles 224, 226 are configured to move along the outer tube orifice 212 as the inner tube 204 and the outer tube 202 are rotated relative to one another. Moreover, the first and second nozzle 224, 226 may provide a spray of water and/or wash liquid to the contents of the cabinet 102 of the dishwasher 100 during operation of the dishwasher 100 (FIGS. 1 and 2).

It should be appreciated, however, that although the spray device assembly 200 of FIGS. 3 and 4 defines the first and second nozzles 224, 226, in other exemplary embodiments, the spray device assembly 200 may alternatively define any other suitable number of nozzles. For example, in other exemplary embodiments, the spray device assembly 200 may only include a single nozzle, or alternatively the spray device assembly 200 may include three (3) nozzles, four (4) nozzles, or any other suitable number of nozzles. The number of nozzles may be altered, for example, based on a slope of the direction in which the inner tube orifice 222 extends relative to the outer tube orifice 212.

Figure 5:
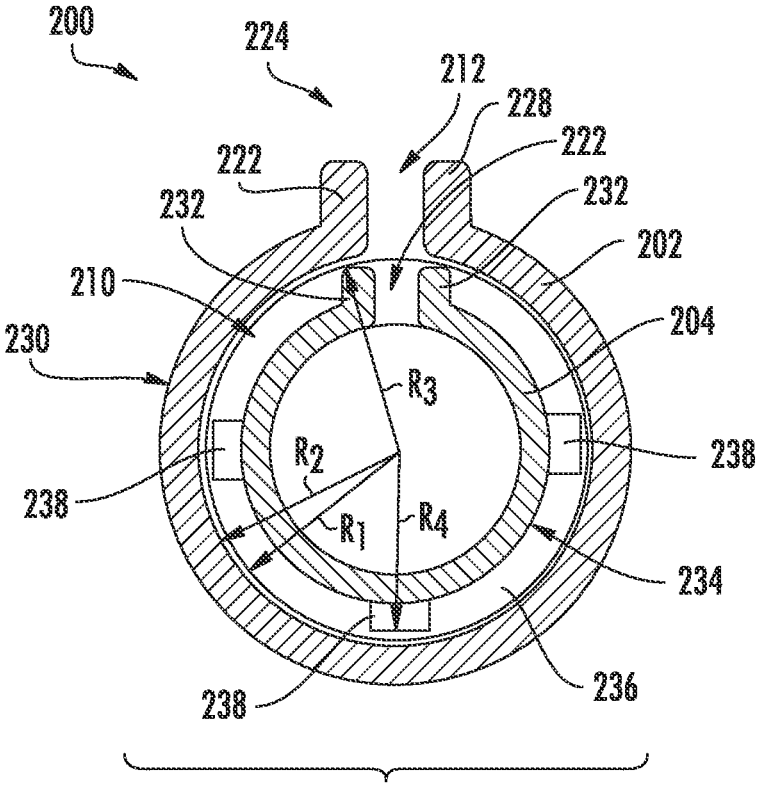
FIG. 5 provides a cross-sectional view of the exemplary spray device assembly of FIG. 3 along a radial direction.

Referring now also to FIG. 5, the outer tube orifice 212 is defined by a pair of outer tube parallel ribs 228 extending along the radial direction R outwardly from an outer surface 230 of the outer tube 202. Similarly, the inner tube orifice 222 is defined by a pair of inner tube parallel ribs 232 extending outwardly along the radial direction R from an outer surface 234 of the inner tube 204. The first nozzle 224 and/or the second nozzle 226 may, in turn, be defined by an alignment of the outer tube parallel ribs 228 and the inner tube parallel ribs 232.

As is depicted, the inner tube 204 of the exemplary spray device assembly 200 additionally includes various other ribs extending outwardly along the radial direction R from the outer surface 234 of the inner tube 204 to, e.g., provide structure for the inner tube 204. For example, the exemplary inner tube 204 depicted in FIGS. 3, 4, and 5 defines one or more annular ribs 236 extending outwardly along the radial direction R from the outer surface 234 of the inner tube 204 and along the circumferential direction C around the outer surface 234 of the inner tube 204. More particularly, for the spray device assembly 200 depicted in FIG. 4, the inner tube 204 defines three (3) annular ribs 236—one positioned at the first end 218, one positioned at the second end 220, and one positioned approximately half-way therebetween. Notably, between the first and second ends 218, 220, the inner tube orifice 222 depicted extends continuously between the one or more annular ribs 236. It should be understood, however, that in other exemplary embodiments of the present disclosure, the inner tube 204 may instead define any other suitable number of annular ribs 236.

The inner tube 204 additionally defines one or more longitudinal ribs 238 to, e.g., provide additional support for the inner tube 204. The one or more longitudinal ribs 238 extend linearly along the length $L_2$ of the inner tube 204 and in a direction outwardly along the radial direction R from the outer surface 234 of the inner tube 204. The exemplary embodiment of FIGS. 3, 4, and 5 includes three (3) longitudinal ribs 238 (FIG. 5), however in other exemplary embodiments the inner tube 204 may alternatively include any other suitable number of longitudinal ribs 238.

Referring particularly to the exemplary embodiment of FIG. 5, the annular ribs 236 and inner tube parallel ribs 232 extend outwardly farther along the radial direction R than the longitudinal ribs 238. For example, the annular ribs 236 define a radius $R_1$ along the radial direction R that is approximately equal to a radius $R_2$ defined by the opening 210 of the outer tube along the radial direction R. Similarly, the inner tube parallel ribs 232 (defining the inner tube orifice 222) also define a radius $R_3$ along the radial direction R that is approximately equal to the radius $R_2$ defined by the opening 210 of the outer tube 202 along the radial direction R. By contrast, however, the longitudinal ribs 238 define a radius $R_4$ along the radial direction R that is less that the radius $R_2$ defined by the opening 210 of the outer tube 202 (and less than the radius $R_1$ defined by the annular ribs 236 and the radius $R_3$ defined by the inner tube parallel ribs 232). Such a configuration may allow for easier rotation of the inner tube 204 relative to the outer tube 202 by decreasing an amount of surface area contact between the inner and outer tubes 204, 202. Moreover, the inner tube parallel ribs 232 may assist in preventing wash liquid from entering a space defined between the outer surface 234 of the inner tube 204 and the opening 210 of the outer tube 202.

It should be appreciated, however, that in other exemplary embodiments, the inner tube 204 may, for example, not include some or all of the ribs extending outwardly along the radial direction R, and may instead or in addition include one or more ribs extending inwardly along the radial direction R. In certain of the alternative embodiments, the outer surface 234 of the inner tube 204 may define a radius that is approximately equal to the radius $R_2$ of the opening 210.

Figure 6:
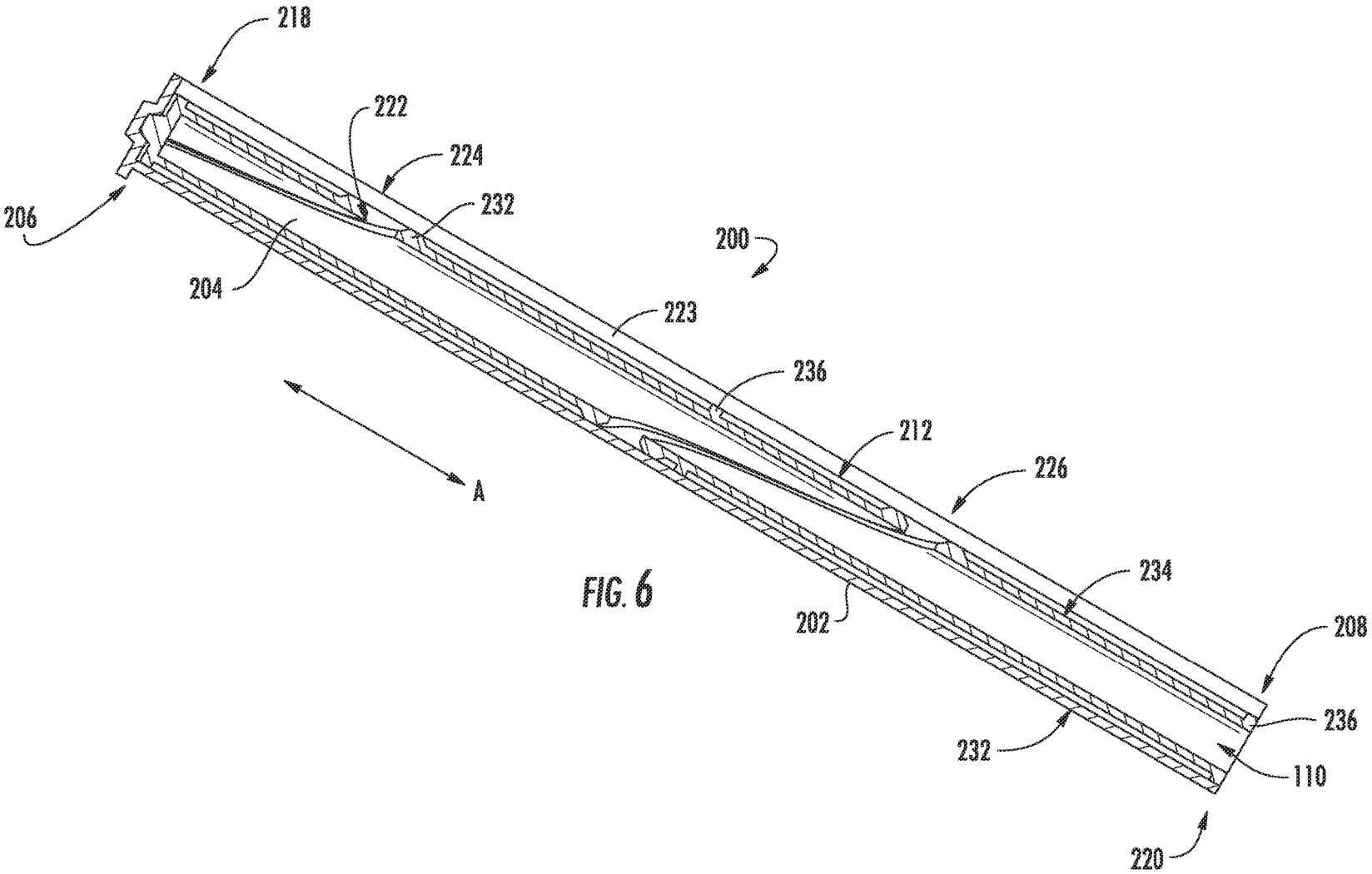
FIG. 6 provides a cross-sectional view of the exemplary spray device assembly of FIG. 3 along an axial direction in a first position.
Figure 7:
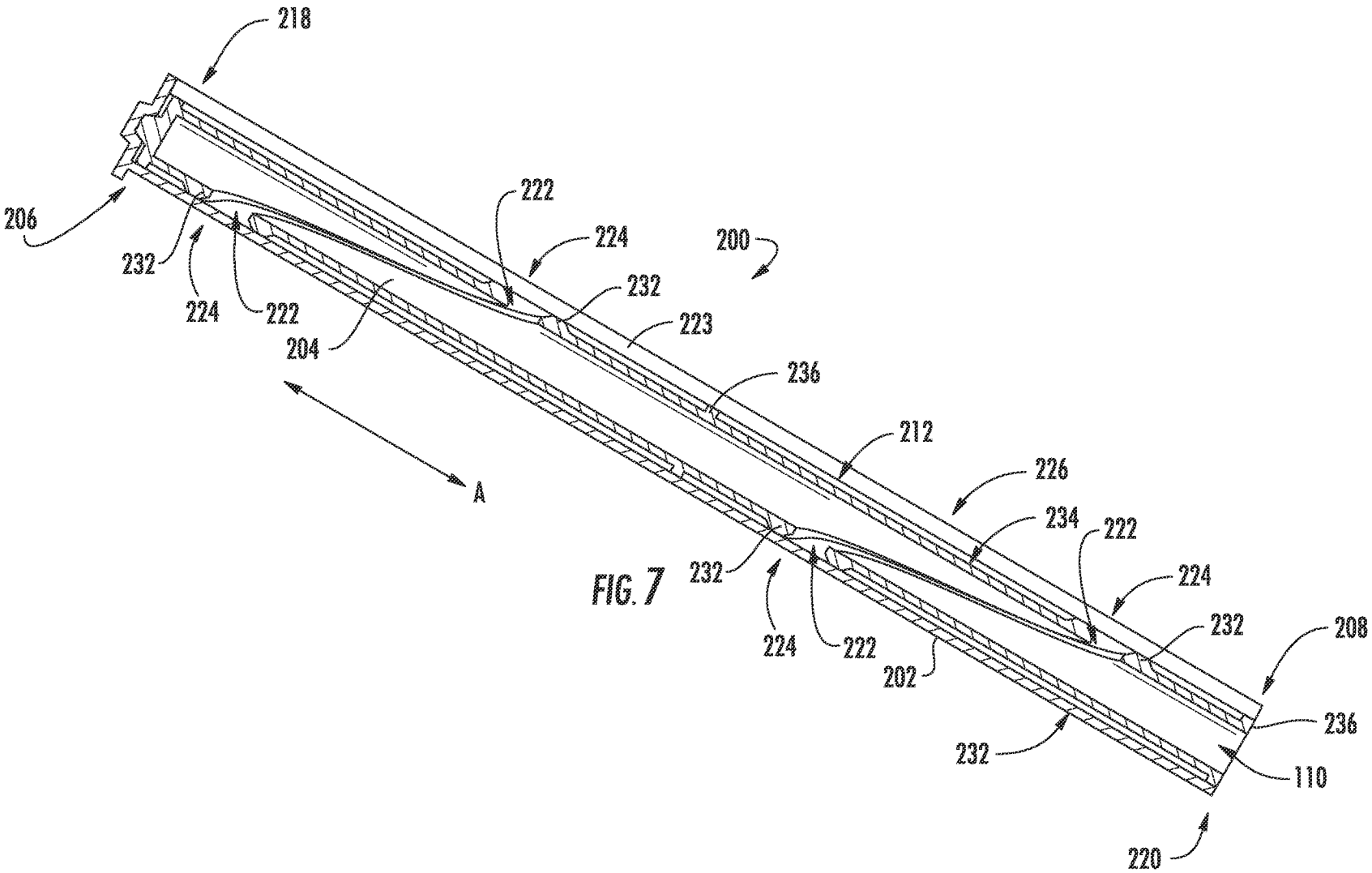
FIG. 7 provides a cross-sectional view of the exemplary spray device assembly of FIG. 3 along the axial direction in a second position.

Referring now to FIGS. 6 and 7, operation of the exemplary spray device assembly 200 of FIG. 3 will be explained in greater detail. More particularly, FIG. 6 provides a cross-sectional view of the exemplary spray device assembly 200 of FIG. 3 along the axial direction A in a first position, and FIG. 7 provides a cross-sectional view of the exemplary spray device assembly 200 of FIG. 3 along the axial direction A in a second position.

For the exemplary embodiment depicted, the spray device assembly 200 may be attached to, e.g., a hub of a spray assembly, such as the hub 152 of the spray assembly 144, or the hub 154 of the spray assembly 148 (FIG. 2). Accordingly, the inner tube 204 may be configured to receive water and/or wash fluid from the circulation assembly through the hub and provide a concentrated spray of the water and/or wash fluid to the contents of the cabinet 102 through the first and/or second nozzles 224, 226. The hub may include one or more features for engaging the inner tube 204 and/or outer tube 202 to rotate the inner and/or outer tubes 204, 202 relative to each other. For example, the hub may include any suitable mechanical, electrical, or electromechanical means for rotating the inner and outer tubes 204, 202 relative to one another.

Referring still to FIGS. 6 and 7, during operation of the dishwasher appliance 100, or more particularly during operation of the spray device assembly 200, the inner tube 204 may be rotated about the axial direction A, and the outer tube 202 may not be rotated about the axial direction A. With such a configuration, the first and second spray nozzles 224, 226 may continuously move along the outer tube orifice 212 along the entire length $L_1$ of the outer tube 202 of the spray device assembly 200. Moreover, with such a configuration, the first and second spray nozzles 224, 226 may be configured to spray water and/or wash liquid in a constant radial direction as they move along the outer tube orifice 212.

Referring specifically to FIG. 6, the spray device assembly 200 is depicted having the inner tube orifice 222 overlap the outer tube orifice 212 twice to define the first and second nozzles 224, 226. Referring now to FIG. 7, the spray device assembly 200 of FIG. 6 is depicted having the inner tube 204 rotated approximately ninety (90) degrees relative to the outer tube 202. As the outer tube 202 and inner tube 204 are rotated relative to one another, the first and second nozzles 224, 226 are moved along the outer tube orifice 212 such that the inner tube orifice 222 overlaps the outer tube orifice 212 at two different locations along the outer tube orifice 212.

It should be appreciated, however, that the exemplary spray device assembly 200 of FIGS. 6 and 7 is provided by way of example only. For example, in other exemplary embodiments, the outer tube 202 may be rotated about the axial direction A, and the inner tube 204 may not be rotated about the axial direction A during operation of the spray device assembly 200. Alternatively, however, both the inner tube 204 and outer tube 202 may be rotated during operation of the spray device assembly 200, either in the same direction at different speeds, or in opposite directions.

A spray device assembly 200 in accordance with the present disclosure may therefore provide increased spray coverage as compared to a spray device assembly including a discrete number of nozzles positioned along the axial direction A. Moreover, a spray device assembly 200 of the present disclosure may provide a more powerful spray through the first and/or second nozzles 224, 226 and/or may be operated using a lower volume pump, given that the spray device assembly 200 may define a lesser number of nozzles through which the flow of water and/or wash fluid is sprayed.

Figure 8:
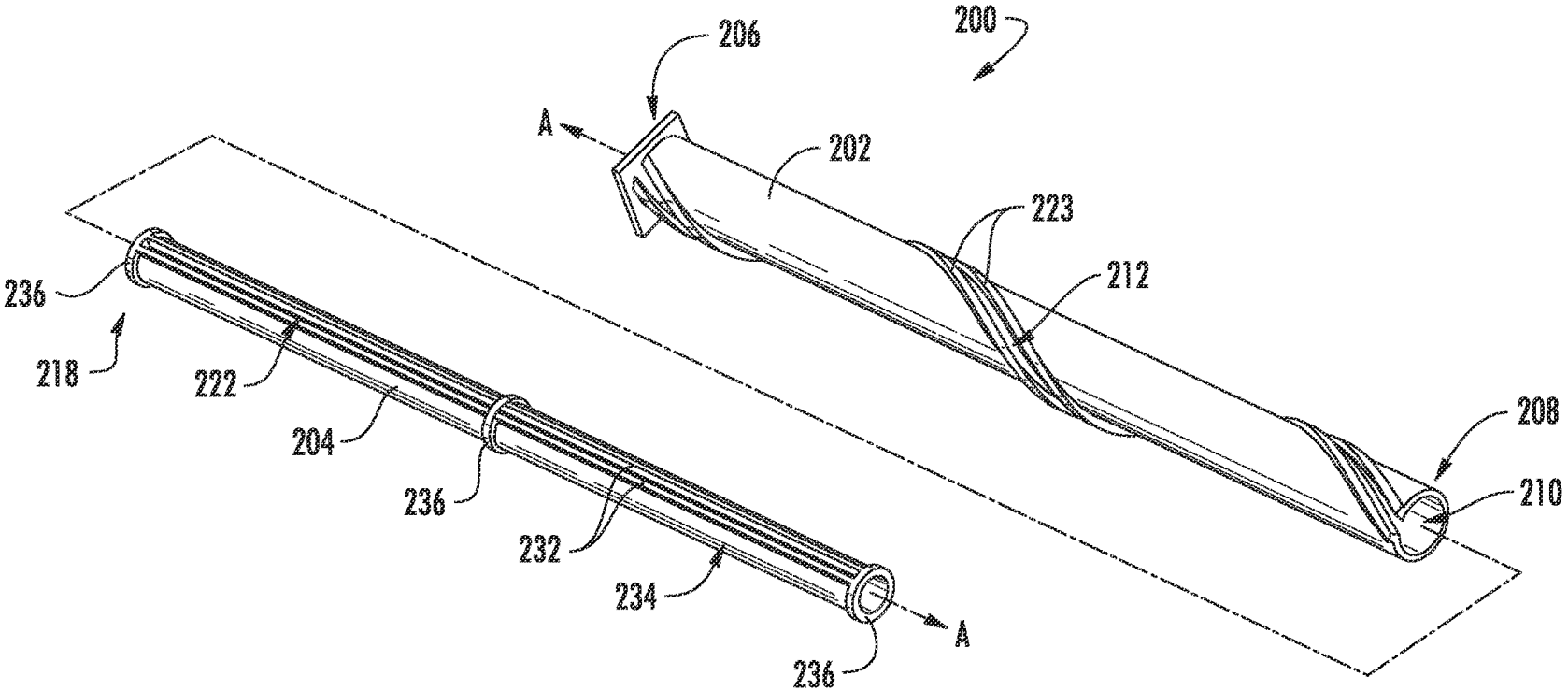
FIG. 8 provides an exploded view of a spray device assembly according to another exemplary embodiment of the present subject matter.

Referring now to FIG. 8, an exploded view of an alternative embodiment of a spray device assembly 200 in accordance with aspects of the present disclosure is provided. The exemplary embodiment of FIG. 8 may be configured in substantially the same manner as the embodiment of FIG. 3. However, for the exemplary embodiment of FIG. 8, the outer tube orifice 212 instead extends helically around the outer tube 202 while the inner tube orifice 222 extends linearly along the inner tube 204. In such an exemplary embodiment, the outer tube 202 may be rotated about the axial direction A during operation of the spray device assembly 200 and the inner tube 204 may not be rotated about the axial direction A. However, in alternative embodiments, the inner tube 204 may instead be rotated about the axial direction A during operation of the spray device assembly 200 and the outer tube 202 may not be rotated about the axial direction A. Notably, if the inner tube 204 is not rotated, the first and second nozzles 224, 226 will spray in the same radial direction R as they move along the outer tube orifice 212 and the axial direction A. By contrast, if the outer tube 202 is not rotated, the first and second nozzles 224, 226 will spray in a radial direction R that rotates circumferentially as the nozzles 224, 226 move along the outer tube orifice 212 and the axial direction A. This is due to the fact that the nozzles 224, 226 track along the outer tube orifice 212 as they move along the axial direction A.

Figure 9:
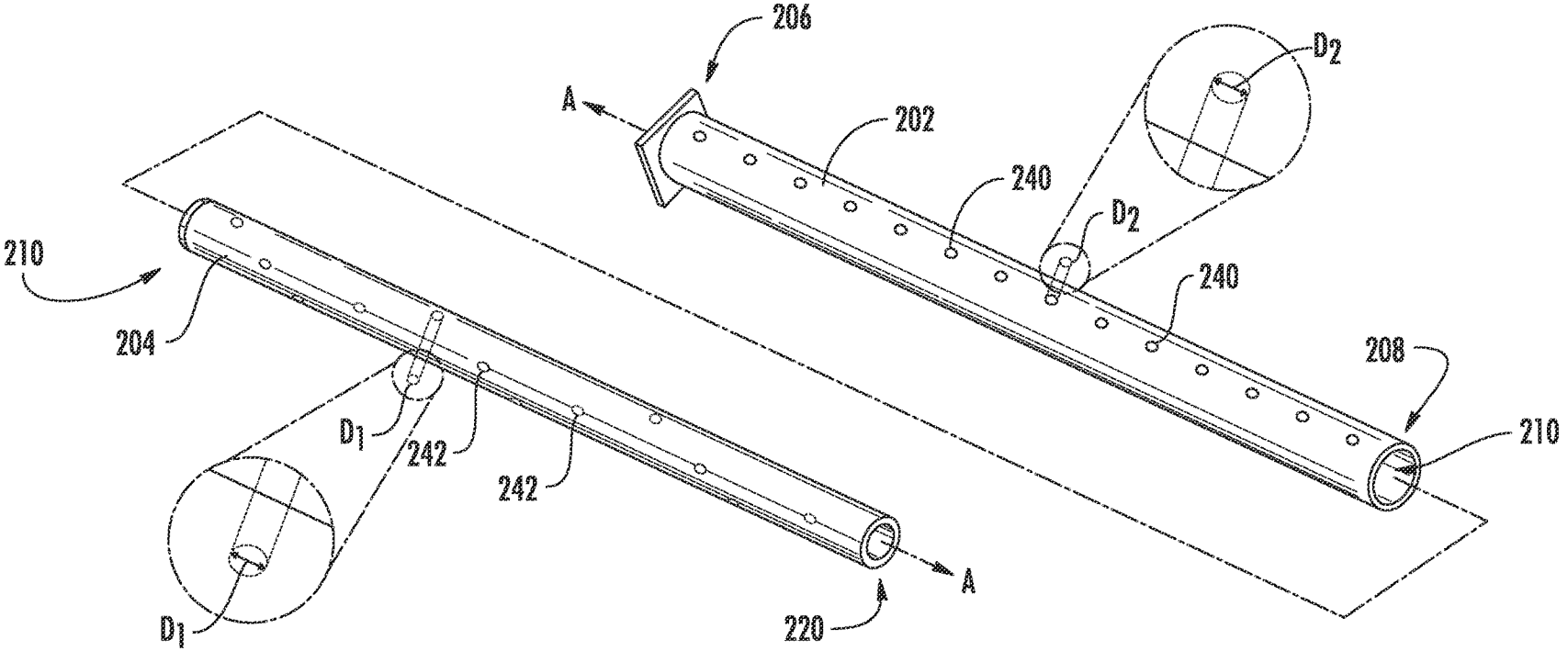
FIG. 9 provides an exploded view of a spray device assembly according to yet another exemplary embodiment of the present subject matter.

Still another embodiment of the present disclosure is provided in FIG. 9. More particularly, FIG. 9 provides an exploded perspective view of another embodiment of the spray device assembly 200 in accordance with aspects of the present disclosure. The exemplary spray device assembly 200 of FIG. 9 may be configured in substantially the same manner as the embodiments of FIG. 3 and/or FIG. 8. However, for the exemplary embodiment depicted, the outer tube 202 and the inner tube 204 do not define an outer tube orifice 212 or an inner tube orifice 222. Instead, the outer tube 202 defines a plurality of outer holes 240 spaced apart from one another along the axial direction A, and the inner tube 204 defines a plurality of inner holes 242 spaced apart from one another along the axial direction A. The plurality of outer holes 240 are distributed along a fixed trajectory along the outer tube 202, and similarly, the plurality of inner holes 242 are distributed along a fixed trajectory along the inner tube 204. As used herein, the term "fixed trajectory" refers to an extension in a constant direction, such as a constant linear direction or a constant helical direction.

As in the previous embodiments, the inner tube 204 is rotatably positioned at least partially within the opening 210 of the outer tube 202. Additionally, the fixed trajectory of the inner holes 242 is non-parallel with the fixed trajectory of the plurality of outer holes 240. The inner holes 242 are configured to sequentially overlap with the outer holes 240 as the inner tube 204 and the outer tube 202 are rotated relative to one another. The overlapping inner and outer holes 242, 240 define a nozzle that moves along the axial direction A as the inner tube 204 and the outer tube 202 are rotated relative to one another.

Moreover, the plurality of inner holes 242 each define a diameter $D_1$ and the plurality of outer holes each define a diameter $D_2$. For the exemplary embodiment depicted, the diameter $D_1$ of each of the inner holes 242 is approximately equal to the diameter $D_2$ of each of the outer holes 240. However, in other exemplary embodiments, the plurality of outer holes 240 may each define a diameter $D_2$ greater than the diameter $D_1$ defined by the plurality of inner holes 240. Alternatively, the plurality of inner holes 242 may each define a diameter $D_1$ greater than the diameter $D_2$ defined by the plurality of outer holes 240.

Additionally, as with the embodiments above, the inner tube 204 may be rotated about the axial direction A during operation of the spray device assembly 200 and the outer tube 202 may not be rotated, or alternatively, the outer tube 202 may be rotated about the axial direction A during operation of the spray device assembly 200 and the inner tube 204 may not be rotated.

Referring still to the exemplary embodiment of FIG. 9, the fixed trajectory of the outer holes 240 is a linear trajectory along the outer tube 202, while the fixed trajectory of the inner holes 242 is a helical trajectory along a length of the inner tube 204. However, in other exemplary embodiments, the fixed trajectory of the outer holes 240 may instead be a helical trajectory along the outer tube 202, while the fixed trajectory of the inner holes 242 may be a linear trajectory along a length of the inner tube 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A spray device assembly configured for a dishwasher appliance defining an axial direction, the spray device assembly comprising:

an outer tube extending along the axial direction, the outer tube defining an opening and an outer tube orifice extending substantially continuously along a length of the outer tube; and an inner tube rotatably positioned at least partially within the opening of the outer tube, the inner tube defining an inner tube orifice extending substantially continuously along a length of the inner tube, the outer tube orifice and inner tube orifice together defining a nozzle intersection point where the outer tube orifice and the inner tube orifice overlap, the nozzle intersection point moving along the outer tube orifice as the inner tube and the outer tube are rotated relative to one another.

2. The spray device assembly of claim 1, wherein the inner tube orifice extends helically around the inner tube, and wherein the outer tube orifice extends linearly along the outer tube.

3. The spray device assembly of claim 1, wherein the outer tube orifice extends in helically around the outer tube, and wherein the inner tube orifice extends linearly along the inner tube.

4. The spray device assembly of claim 1, wherein the spray device assembly further defines a radial direction, and wherein the inner tube orifice is defined by a pair of parallel ribs extending outwardly along the radial direction from an outer surface of the inner tube.

5. The spray device assembly of claim 1, wherein the spray device assembly further defines a radial direction and a circumferential direction, and wherein the inner tube defines one or more annular ribs, each extending outwardly along the radial direction from an outer surface of the inner tube and along the circumferential direction around the outer surface of the inner tube.

6. The spray device assembly of claim 5, wherein the inner tube defines a first end and a second end, and wherein between the first and second ends, the inner tube orifice extends continuously between the one or more annular ribs.

7. The spray device assembly of claim 5, wherein the one or more annular ribs define a radius that is approximately equal to a radius of the opening of the outer tube.

8. The spray device assembly of claim 1, wherein the spray device assembly is configured as one of the following: a spray arm assembly, a stationary spray device assembly, a dedicated spray device assembly for a silverware rack, a dedicated spray device assembly for washing bottles, or a linear movement spray device assembly.

9. The spray device assembly of claim 1, wherein the inner tube is rotated about the axial direction A during operation of the spray device assembly and the outer tube is not rotated about the axial direction A.

10. The spray device assembly of claim 1, wherein the inner tube orifice and the outer tube orifice further define a second nozzle intersection point where the inner tube orifice and the outer tube orifice overlap at a second location, wherein the second nozzle intersection point also moves along the outer tube orifice as the inner tube and the outer tube are rotated relative to one another.

11. The spray device assembly of claim 1, wherein the outer tube orifice extends between a first end and a second end of the outer tube, and wherein the inner tube orifice extends between a first end and a second end of the inner tube orifice.

12. A dishwasher appliance comprising:

a cabinet defining a wash compartment;

a circulation assembly fluidly connected to the wash compartment for circulating a wash liquid; and a spray device assembly defining an axial direction and configured to receive wash liquid from the circulation assembly, the spray device assembly comprising an outer tube extending along the axial direction, the outer tube defining an opening and an outer tube orifice extending substantially continuously along a length of the outer tube; and an inner tube rotatably positioned at least partially within the opening of the outer tube, the inner tube defining an inner tube orifice extending substantially continuously along a length of the inner tube, the outer tube orifice and inner tube orifice together defining a nozzle intersection point where the outer tube orifice and the inner tube orifice overlap, the nozzle intersection point moving along the outer tube orifice as the inner tube and the outer tube are rotated relative to one another.

13. The dishwasher appliance of claim 12, wherein the inner tube orifice extends helically around the inner tube, and wherein the outer tube orifice extends linearly along the outer tube.

14. The dishwasher appliance of claim 12, wherein the spray device assembly further defines a radial direction and a circumferential direction, and wherein the inner tube defines one or more annular ribs, each extending outwardly along the radial direction from an outer surface of the inner tube and along the circumferential direction around the outer surface of the inner tube.

15. The dishwasher appliance of claim 12, wherein the inner tube is rotated about the axial direction A during operation of the spray device assembly and the outer tube is not rotated about the axial direction A.

16. The dishwasher appliance of claim 12, wherein the outer tube orifice extends between a first end and a second end of the outer tube, and wherein the inner tube orifice extends between a first end and a second end of the inner tube orifice.

* * * * *